US007310989B2

(12) United States Patent
Caporusso

(10) Patent No.: US 7,310,989 B2
(45) **Date of Patent: *Dec. 25, 2007**

(54) HYDRAULIC CIRCUIT FOR LINEARLY DRIVING A MOVABLE ROLLER-HOLDER SLIDER OF A PIPE BENDING MACHINE

(75) Inventor: Alessandro Caporusso, Piedimonte San Germano (IT)

(73) Assignee: CML International S.p.A., Piedimonte San Germano (IT)

( * ) Notice: Subject to any disclaimer, the term of this patent is extended or adjusted under 35 U.S.C. 154(b) by 477 days.

This patent is subject to a terminal disclaimer.

(21) Appl. No.: 10/483,833

(22) PCT Filed: Jul. 18, 2001

(86) PCT No.: PCT/IT01/00381

§ 371 (c)(1),
(2), (4) Date: Jun. 7, 2004

(87) PCT Pub. No.: WO03/008126

PCT Pub. Date: Jan. 30, 2003

(65) Prior Publication Data

US 2004/0216507 A1 Nov. 4, 2004

(51) Int. Cl.
*B21D 11/00* (2006.01)

(52) U.S. Cl. ..... 72/453.02; 72/175

(58) Field of Classification Search ..... 72/453.02
See application file for complete search history.

(56) References Cited

U.S. PATENT DOCUMENTS

| | | | | |
|---|---|---|---|---|
| 2,494,984 | A * | 1/1950 | Bauer | 266/97 |
| 3,180,124 | A * | 4/1965 | Robra | 72/20.2 |
| 4,918,958 | A | 4/1990 | Glomb et al. | |
| 6,173,598 | B1 | 1/2001 | Caporusso et al. | |

FOREIGN PATENT DOCUMENTS

| | | |
|---|---|---|
| DE | 22 57 368 | 6/1974 |
| DE | 197 51 504 | 7/1998 |

* cited by examiner

*Primary Examiner*—Derris H. Banks
*Assistant Examiner*—Debra M Wolfe
(74) *Attorney, Agent, or Firm*—Young & Thompson

(57) ABSTRACT

A hydraulic circuit for linearly driving a movable roller-holder slider of a pipe bending machine, comprising a hydraulic cylinder (5) whose piston rod is connected to a slider holding a movable roller, the cylinder being fed with pressurized fluid from a reservoir (16) by a pump (15), through a three-position four-way valve (18), a check valve (12, 13) and an interposed throttling valve (19), that is operated to generate an increased pressure in said low pressure chamber of the hydraulic cylinder (5) in order to slow down the slider holding the upper roller in its primary motion when a programmable interval is reached from said predetermined position for each working pass.

1 Claim, 4 Drawing Sheets

HYDRAULIC CIRCUIT FOR LINEARLY DRIVING A MOVABLE ROLLER-HOLDER SLIDER OF A PIPE BENDING MACHINE

FIELD OF THE INVENTION

This invention relates to a hydraulic circuit for linearly driving a movable roller-holder slider of a pipe bending machine. The pipe bending machine can be of any kind, both symmetrical or asymmetrical. For simplicity and clarity sake a pyramidal, symmetrical pipe bending machine is referred to below.

BACKGROUND OF THE INVENTION

An upper roller among three rollers of an existing pyramidal, symmetrical pipe bending machine is generally mounted on a slider that is vertically movable by a hydraulic cylinder. The hydraulic circuit ensuring that the movable roller-holder slider is linearly driven comprises a hydraulic cylinder whose rod is connected to the roller-holder slider. The hydraulic cylinder has an upper chamber and a lower chamber, both chambers communicating with respective ducts of pressurized fluid that is feed from a reservoir by a pump. A three-position four-way valve and a check valve operate on both ducts. These valves, as well as the pump, are controlled by an electronic control unit.

The roller-holder slider travels downward in a primary motion to a bending position and upward in a return motion to a rest position.

As known, pipes or other section bars are bent among the three rollers of a pipe bending machine through an operation including one pass or more with a result of the desired deformation. In order to obtain this deformation, specially when one workpiece or more has to be bent exactly with the same bending radius, one must keep for every workpiece the same position of the movable roller with respect to the fixed rollers, wherein the bending operation is performed.

The valves in the hydraulic circuit, controlled by the electronic control unit, do not ensure an exact positioning of the hydraulic cylinder rod at the required vertical position in the various passes. This is owing to a number of forces in action, among which the frictional force in the downward motion, the resistance of the material of the workpiece to be bent, the active forces of the piston of the hydraulic cylinder, the seal deflecting force, the elastic force of the piston ring, the counteracting differential thermodynamic force, the time constant of the control response of the electromagnetic valve, the viscosity of the hydraulic fluid and its non homogeneity due to the presence of air having a coefficient of compressibility different from that one of the hydraulic fluid.

In order to remedy the imprecision of the actual point of halting the movable roller-holder slider, mechanical stops have been used in the past that can ensure, without ascertainable error, the exact position of the movable roller in which a respective bending pass has to be performed.

However, to set the points of halting by mechanical stops is a troublesome operation, that involves an added effort and waste of time, in particular when deformations with great radiuses of curvature have to be performed.

Further, in the past, in order to solve the problem, complicate hydraulic circuits provided with proportional valves involving increased costs have been used.

OBJECT OF THE INVENTION

The present invention aims to overcome the drawbacks above mentioned.

In particular, an object of the present invention is to allow a pipe bending machine to operate, determining with precision the position of pipe bending while a position of bending can be set without requiring a mechanical stop device.

SUMMARY OF THE INVENTION

Therefore, the present invention provides a hydraulic circuit for linearly driving a movable roller-holder slider of a pipe bending machine, comprising a hydraulic cylinder whose piston rod is connected to a slider holding a movable roller that travels in its primary motion to a predetermined position for each pass of one or more passes of working operation of a workpiece to be bent and in its return motion to a rest position, the hydraulic cylinder having a high pressure chamber and a low pressure chamber, both chambers communicating with respective ducts of pressurized fluid fed from a reservoir by a pump, ducts on which a three-position four-way valve and a check valve operate, further comprising, between said valves, a throttling valve, that is operated by an electromagnet to generate an increased pressure in said low pressure chamber of the hydraulic cylinder in order to slow down the slider holding the upper roller in its primary motion when a programmable interval is reached from said predetermined position for each working pass.

BRIEF DESCRIPTION OF THE DRAWINGS

The invention will be now described with reference to its preferred embodiment, although it has to be understood that modifications can be made to the invention without departing from the spirit thereof, referring to the figures of the accompanying drawing, in which.

DETAILED DESCRIPTION OF THE INVENTION

Figure 1:
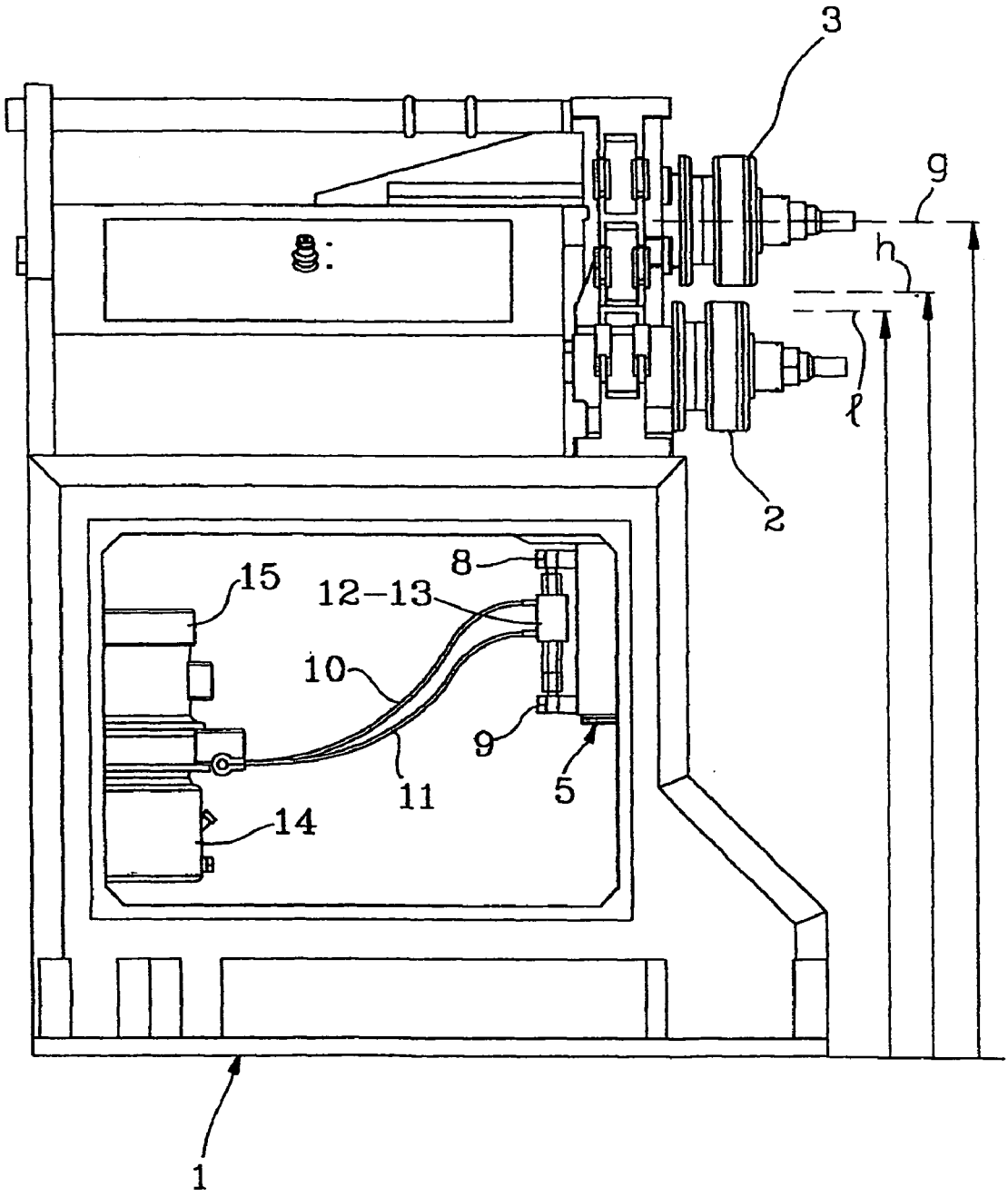
FIG. 1 shows a diagrammatic side view of a partially opened pipe bending machine, to which a hydraulic circuit according to the invention is applied.

Referring to the drawing, the general appearance of a pipe bending machine, generally denoted as 1, is shown in FIG. 1. The pipe bending machine 1 is equipped with a hydraulic circuit according to the invention.

The pipe bending machine shown by way of example is of a symmetrical pyramidal kind. It has frontally (on the right hand side in FIG. 1) a pair of fixed lower rollers (only one roller, denoted as 2, is shown) and an upper roller 3. The upper roller 3 is mounted conventionally on a slider (not shown) that is connected to a piston rod 4 diagrammatically represented in FIG. 2. The piston rod 4 is a part of a hydraulic cylinder 5 having an upper chamber 6 and a lower chamber 7.

Owing to the motion of the piston rod 4, the slider holding the upper roller 3 is movable downward during a primary motion from a general position indicated by an axis g to a predetermined position of axis 1, as shown in an explanatory way in FIG. 1. The bending operation of a workpiece (not shown) is performed during a travel including one pass or more. In every pass, said predetermined position of axis l is selected for each workpiece. If e.g. it is intended that two equal workpieces to be bent are worked by two passes, and an equal end position of pipe bending, but a different intermediate position is chosen for every workpiece to be bent, two workpieces with different dimensional characteristics would be obtained.

One would appreciate the importance that bending positions are achieved exactly as much as possible.

Figure 2:
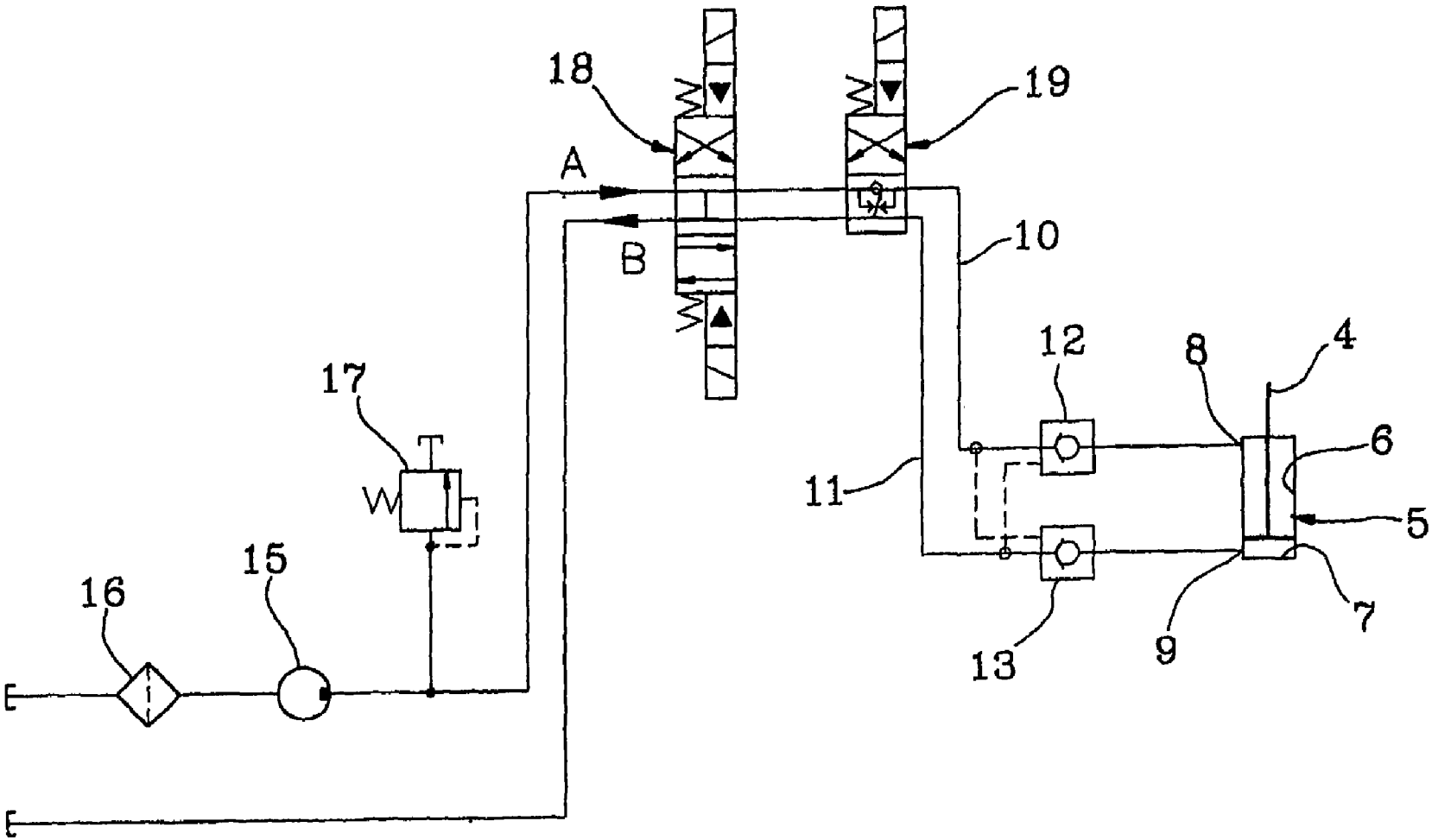
FIG. 2 shows a diagram of hydraulic circuit according to the invention.

As constructively and diagrammatically shown in FIGS. 1 and 2 respectively, the upper chamber 6 and the lower chamber 7 of the hydraulic cylinder 5 are communicating through their ports 8 and 9 with respective ducts 10 and 11 of pressurized fluid, and a pilot-operated to close check valve, that consists of a pair of single-acting valve 12 and 13, is provided.

A pressurized fluid, in general oil for hydraulic circuits, is fed from a reservoir 14 through a motor-pump unit 15. As best shown in FIG. 2, at least a filter 16 and a pilot-operated safety valve 17 are provided in the circuit of the pump. Further conventionally, a three-position four-way valve 18 operates on both ducts 10 and 11. The valves, as well as the pump, are controlled by an electronic control unit (not shown).

According to the invention, a throttling valve 19, that is controlled by an electromagnet, is joined to the valve 18 on the same ducts 10 and 11.

Also the throttling valve 19 is operated by said electronic control unit (not shown) to generate a back pressure in the lower chamber 7 of the hydraulic cylinder 5. In fact, in the primary motion, i.e. in the downward travel of the movable roller 3, when the predetermined bending position which is defined by the axis l of the movable roller is approaching, it is suitable to slow down the slider holding the upper roller 3 so that the last one can reach exactly the bending position. This deceleration, e.g. from the position of axis h is obtained by operating, as desired, the throttling valve 19 in order to gradually slow down the movable roller travelling downward, up to the complete closure of the valve in the desired end position for the bending pass that is performed.

The interval h-l inside which the slow down is performed is programmable according to the desired precision and so on.

This deceleration is obtained through the combined operation of the three-position four-way valve 18 and the throttling valve 19, as shown in FIGS. 3 to 6.

In these figures a streamline of high pressure fluid coming from the pump unit 15 is indicated as A, and a streamline of low pressure fluid returning from the hydraulic cylinder 5 operating the slider holding the upper roller 3 is indicated as B.

Figure 4:
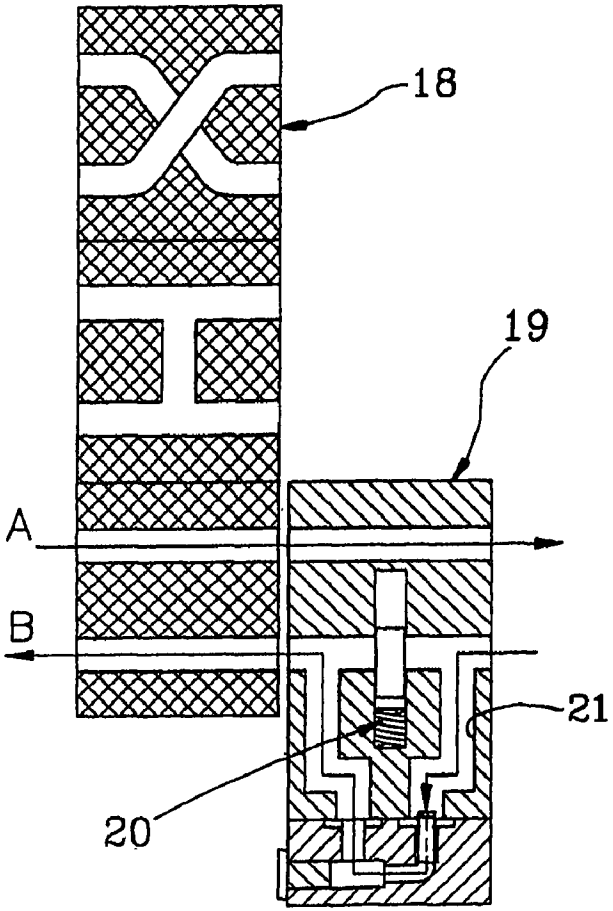
FIGS. 3 to 6 show different operative positions of two valves of the hydraulic circuit according to the invention in its operation on the pipe bending machine.
Figure 3:
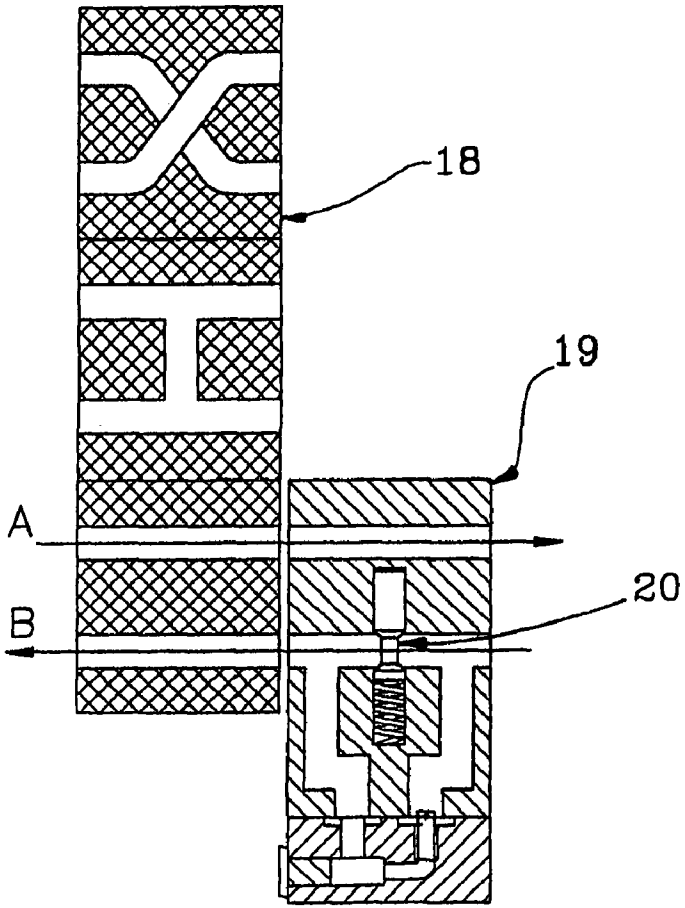

Referring to FIG. 3, the three-position four-way valve 18 and the throttling valve 19 are shown in an arrangement in which the high pressure streamline A goes to the high pressure chamber 6 of the cylinder, and the low pressure streamline B indicates the return flow exiting the low pressure chamber 7. The throttling device, denoted as 20, of the throttling valve 19 is in a non working arrangement and remains in this position until the predetermined position of axis h of the movable roller 3 is reached (FIG. 1). From this position the throttling device 20 is operated, as shown in FIG. 4. The streamline B is diverted to a bypass 21, where the rate of flow is reduced.

Consequently, there is a pressure increasing in the low pressure chamber 7 of the cylinder 5. As a result, the downward travel of the movable roller 3 is slowed until the position of axis l is reached in which the flow is stopped, and both chambers 6 and 7 are under the same operating pressure. In the same time, all slacks are taken up, including air balls that are the decisive factor of error by having a compressibility different from that one of the hydraulic fluid. Now, the three-position four-way valve 18 and the throttling valve 19 are brought to a rest arrangement shown in FIG. 5.

Figure 6:
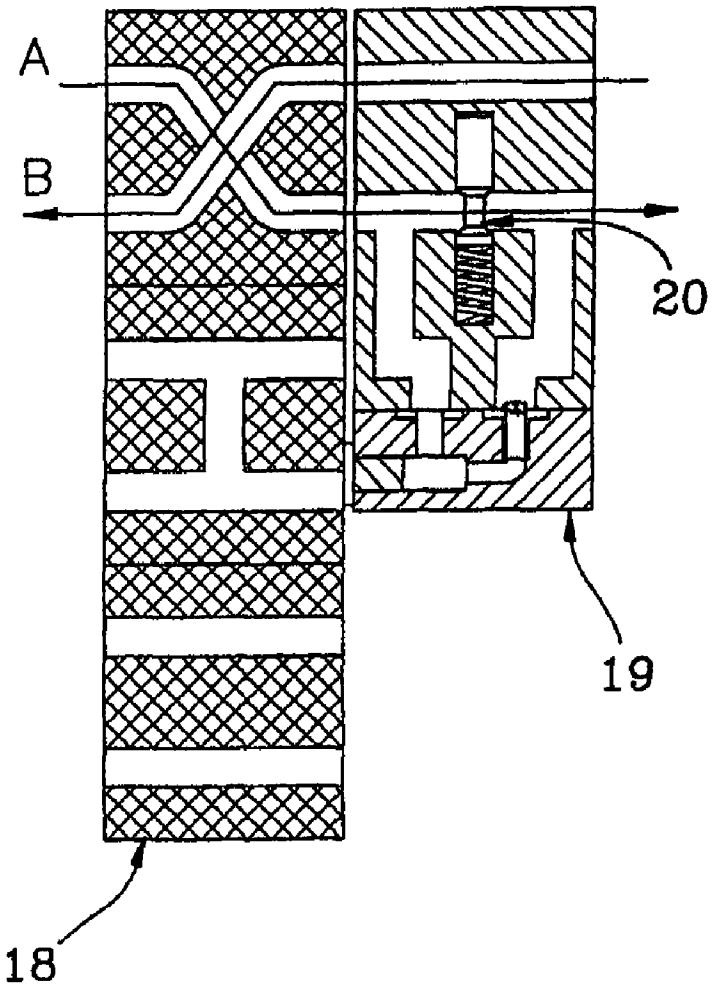
Figure 5:
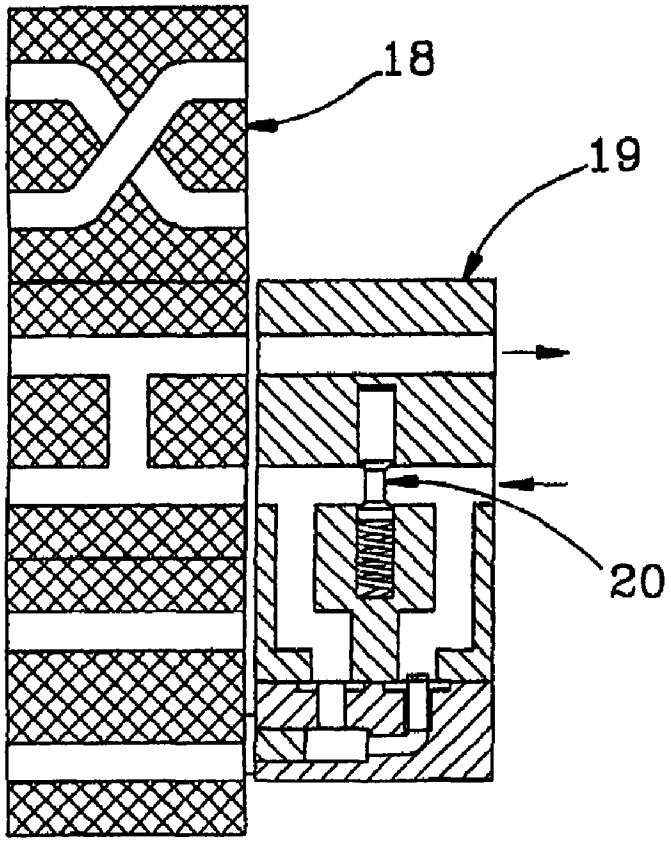

In order to return the movable roller 3 to its former position of axis g, the three-position four-way valve 18 and the throttling valve 19 are brought to an arrangement shown in FIG. 6 in which the throttling device 20 is not working. Now, as for the throttling valve 19, the arrangement of FIG. 3 is repeated, while the three-position four-way valve 18 performs the backflow. Through this operation, the chamber 7 of the cylinder 5 becomes the high pressure chamber, while the chamber 6 becomes the low pressure chamber.

The throttling valve 18 can be a unidirectional valve. In alternative, the throttling valve 18 can be a bi-directional valve, in order to assure a slow down in both primary and return motions.

The present invention has been described with reference to its specific embodiment, but it would be expressly understood that modifications, addition and/or omissions can be made without departing from the spirit of invention as defined in the enclosed claims.

The invention claimed is:

1. A hydraulic circuit for linearly driving a movable roller-holder slider of a pipe bending machine, comprising a hydraulic cylinder whose piston rod is connected to a slider holding a movable roller that travels in its primary motion to a predetermined position for each pass of one or more passes of working operation of a workpiece to be bent and in its return motion to a rest position, the hydraulic cylinder having a high pressure chamber and a low pressure chamber, both chambers communicating with respective ducts of pressurized fluid fed from a reservoir by a pump, ducts on which a three-position four-way valve and a check valve operate, characterized in that the hydraulic circuit further comprises, between said valves, a throttling valve, that is operated by an electromagnet to generate an increased pressure in said low pressure chamber of the hydraulic cylinder in order to slow down the slider holding the upper roller in its primary motion when a programmable interval is reached from said predetermined position for each working pass.

* * * * *